United States Patent [19]

Wolfhugel

[11] 4,396,090

[45] Aug. 2, 1983

[54] MUFFLER

[75] Inventor: Gilbert Wolfhugel, Wissembourg, France

[73] Assignee: Construction Metallurgique de Wissembourg S.A. Wimetal

[21] Appl. No.: 361,042

[22] Filed: Mar. 23, 1982

[30] Foreign Application Priority Data

Mar. 26, 1981 [FR] France ..... 81 06066

[51] Int. Cl.[3] ..... F01N 1/10; F01N 7/18

[52] U.S. Cl. ..... 181/282; 181/243; 181/252; 181/272

[58] Field of Search ..... 181/243, 249, 250, 252, 181/255, 256, 272, 282

[56] References Cited

U.S. PATENT DOCUMENTS

| | | | |
|---|---|---|---|
| 2,707,033 | 4/1955 | Moerke et al. | 181/272 X |
| 2,943,695 | 7/1960 | Jeffords | 181/243 |
| 3,638,756 | 1/1972 | Thiele | 181/282 X |
| 4,108,274 | 8/1978 | Snyder | 181/243 X |

*Primary Examiner*—Benjamin R. Fuller

*Attorney, Agent, or Firm*—Toren, McGeady and Stanger

[57] ABSTRACT

A muffler for a motor vehicle is made up of a housing enclosing a pair of sheet metal plates impressed with semi-circular depressions with the plates combining to form a sinuously shaped gas duct of circular cross section. Walls positioned within the housing divide its interior into chambers. Perforations in the gas duct open into the chambers. Lugs are punched out of the sheet metal plates in a uniform pattern and the lugs in one plate are inserted through the corresponding punched openings in the other and are bent into locking engagement with the other plate. These lugs and the corresponding openings contribute to the mechanical strength of the muffler. The ends of the plates forming the inlet and outlet ends for the gas duct have flanges which also contribute to the mechanical strength of the muffler. Cooperating interfitting corrugations in the plates located at specific positions relative to the gas duct prevent partial short circuiting of the exhaust gas flow through the muffler.

5 Claims, 9 Drawing Figures

FIG. 3
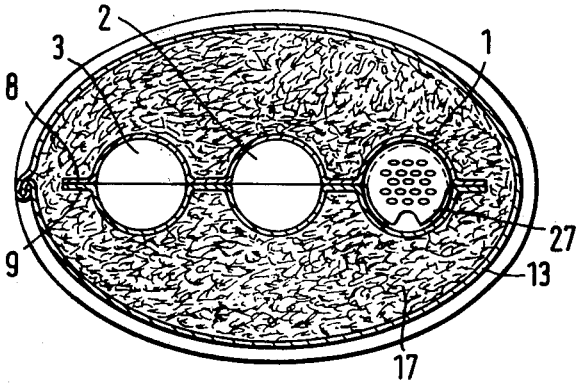
FIG. 4
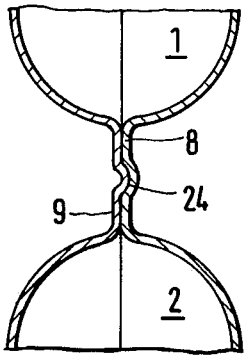
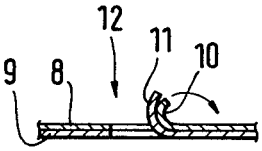
FIG. 5

FIG. 8
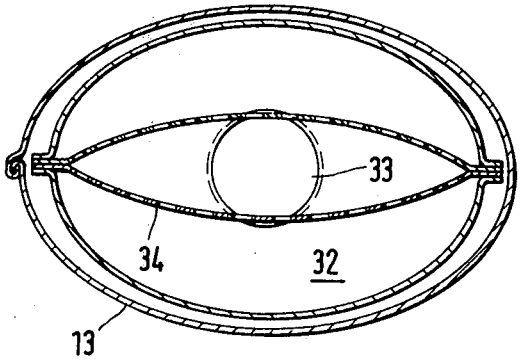
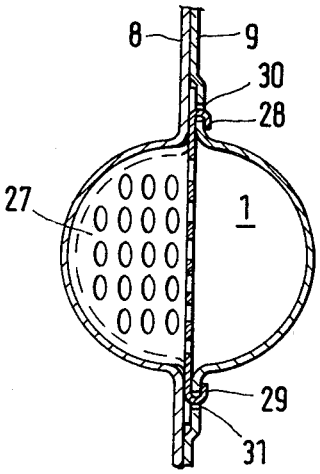
FIG. 9

MUFFLER

SUMMARY OF THE INVENTION

The present invention is directed to a muffler or sound absorber for a motor vehicle and is based on the conventional arrangement where the gas duct extends in a S-shape or sinuous shape and is formed by two plates connected to one another each having a semi-circular depression.

Due to the semi-circular depressions formed in the plates, when the plates are fitted together a gast duct is formed of circular cross-section. Individual areas of the gas duct are provided with perforations. A housing having an oval cross-section encloses the plates. Spaces between the gas duct formed by the plates and the housing are filled with mineral wool, such as basaltic rock wool. To increase the rigidity of the overall structure and to form individual chambers between the gas duct and the housing, walls are provided within the housing extending generally transversely of the gas duct.

Certain problems are solved with a muffler of this general construction. The sinuous or S-shaped gas duct affords a considerably great length of the duct so that the overall length of the muffler is approximately one-third of the overall length of the gas duct. Manufacturing the gas duct from the two plates or half shells is relatively simple.

There are, however, certain features of this design in need of improvement. If the two sheet metal plates or half shells are welded together, the welding operation is relatively difficult and expensive. Between separate parts of the S-shape gas duct, partial "short circuits" occur which significantly impair the sound absorbing ability. The arrangement and attachment of gas deflectors within the gas duct is a complicated operation.

Therefore, the primary object of the present invention is, based on the known arrangement, to improve the interengagement of the sheet metal plates or half shells to facilitate their assembly and, in particular, to prevent the development of the previously observed partial short circuits.

In accordance with the present invention, a muffler of the type described above where the gas duct is formed of two sheet metal plates or half shells, lugs are punched out of the plates in a uniform pattern and the lugs of one plate are inserted into the openings of the other and are bent over assuring the required interlocking of the plates while affording the desired alignment of the depressions forming the gas duct. Further, to prevent the problem of partial short-circuiting, corrugations or the like are pressed in each of the plates so that the corrugations fit together. Preferably, these corrugations or depressions are formed in the curved inlet area of the gas duct. The interengaging corrugations interlock and are located between adjoining parts of the gas duct.

In accordance with the present invention, initially, a simple mechanical interconnection of the sheet metal half shells or plates is attained. Difficulties which occur during welding, for instance the distortion of the sheet metal, are avoided. The interconnection of the sheet metal plates is simple and safe to achieve and holds the plates securely together even during extended operating periods of the muffler. Furthermore, partial short circuiting, especially at the inlet region of the muffler, is suppressed.

Another advantageous feature is the formation of cooperating flanged parts on the sheet metal plates which form the inlet and outlet for the gas duct with these flanges being bent at an angle less than 90° so that an improved connection is achieved and the mechanical strength is increased.

Gas deflectors can be located within the gas duct supported by lugs formed in one of the sheet metal sheets and secured within corresponding openings in the other sheet. When the lugs are inserted through the openings they are bent over to provide the desired securement of the deflectors.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 3 is a cross sectional view taken along the line III—III in FIG. 1;

FIG. 4 is a partial cross sectional view on an enlarged scale, taken along the line IV—IV in FIG. 2;

FIG. 5 is a partial cross sectional view, also shown on an enlarged scale and taken along the line V—V in FIG. 2;

FIG. 8 is a sectional view taken along the line VIII—VIII in FIG. 6; and FIG. 9 is a partial sectional view shown on an enlarged scale and taken along the line IX—IX in FIGS. 2 and 7.

DETAILED DESCRIPTION OF THE INVENTION

Figure 1:
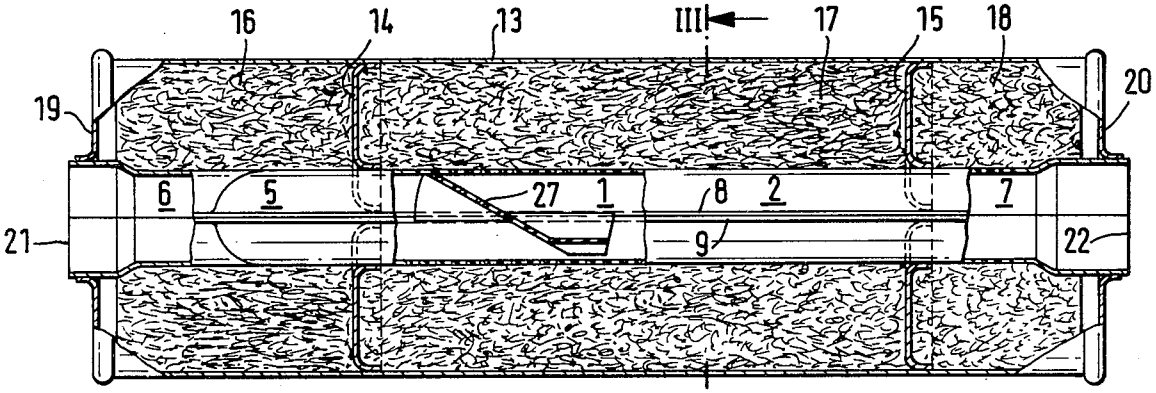
FIG. 1 is a side view, partly in section, of a muffler embodying the present invention.

In the drawing the mufflers illustrated each have a sinuous or S-shaped gas flow duct with three basically straight parts 1, 2, 3 connected by generally U-shaped curved parts. The curved parts 4 and 5 are located intermediately along the length of the gas flow duct. At the inlet 21 to the gas duct there is a curved inlet part 6 and at the opposite end an outlet part 7. With the exception of the curved parts 4, 5, the other parts of the gas duct have perforations through the wall forming the part. A housing laterally encloses the gas duct and the perforations permit communication between the inside of the gas duct and the interior of the housing enclosing the duct. The duct is formed by two sheet metal plates or half shells 8, 9 each having a corresponding impression or depression of semi-circular cross section in the configuration of the S-shaped gas duct. When the two sheet metal plates 8, 9 are connected together, the depressions in the plates are aligned opposite one another and combine to form the S-shaped gas duct of circular cross-section.

Figure 2:
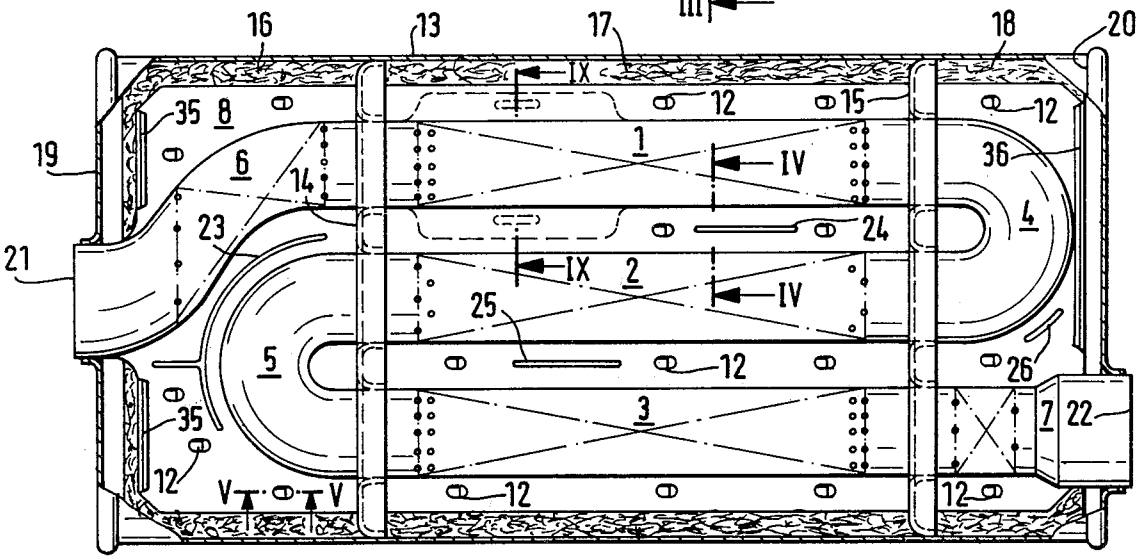
FIG. 2 is a plan view of the muffler shown in FIG. 1 with the top half of the muffler assembly removed.

The two sheet metal plates are connected together in a simple manner by means of punched out lugs 10. When the lugs are punched out an opening is formed so that a lug on the opposite plate can be inserted through the opening and bent over to provide the desired locked connection of the plates. The punched areas 12 of the plates 8,9 which form the lugs 10 are distributed in a generally uniform manner over the surfaces of the sheet metal plates, note FIGS. 2 and 7. Such interengagement of the two plates assures a perfect connection between them.

The plates 8, 9 are laterally enclosed by the housing 13 which has an oval cross sectional shape, note FIG. 3. Between the outside of the sheet metal plates 8, 9 and the inside surface of the housing 13, walls 14, 15 are positioned to enhance the mechanical strength of the overall muffler assembly and also serve to divide the space between the plates and the housing into absorption chambers 16, 17, 18, note FIGS. 1 and 6. Chambers 16, 17 and 18 are filled with an absorptive fibrous material, preferably mineral wool, such as basaltic rock wool. Housing 13 is closed at both ends by walls 19, 20 with the inlet 21 of the gas duct extending through the end wall 19 and the outlet 22 extending through the end wall 20.

To improve the prevention of partial short circuiting of the flow through the gas duct, at certain areas the sheet metal plates 8, 9 are provided with aligned corrugations or depressions 23, 24, 25 and 26. When the plates are fitted together, the corrugations fit one into the other and form a type of labyrinth seal. These corrugations are located where the problem of short circuiting is pronounced. In particular, the area between the inlet part 6 and the curved part 5 is one where partial short circuiting occurs, particularly because of the strong pulsation of the gas stream. Accordingly, at this location, the longest corrugation 23 is formed.

If a gas deflector 27 is located in the gas duct, it is held in position by lugs 28, 29 which fit through corresponding openings 30, 31 in one of the sheet metal plates, for instance, plate 9. The deflector 27 is secured in place by bending the lugs over against the plate. The opposite ends of the plates 8, 9 are provided with flanges 35, 35 which improve the interconnection of the sheet metal plates and the overall strength of the muffler assembly.

Figure 6:
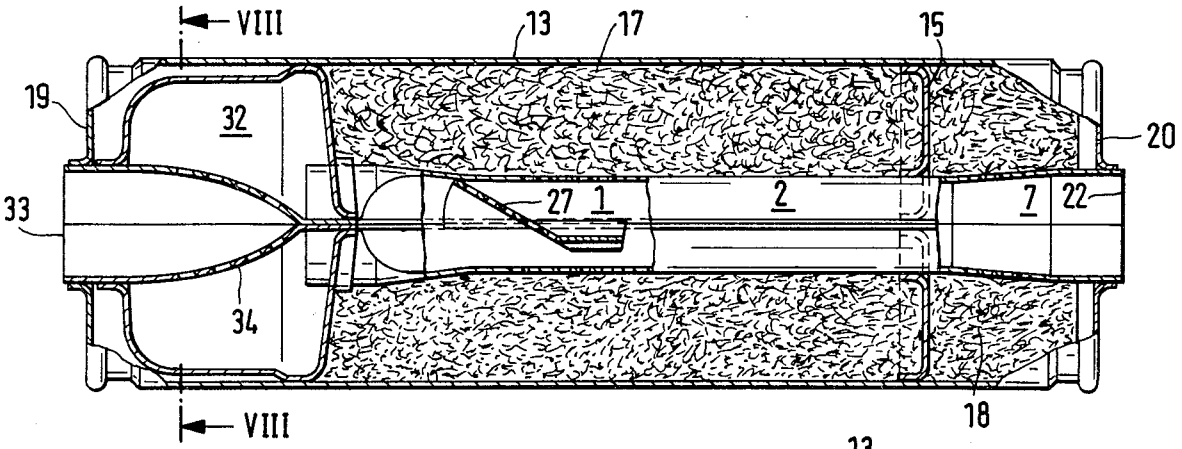
FIG. 6 is a side view shown, mostly in section, of another embodiment of a muffler formed in accordance with the present invention with a reflection chamber located upstream of the absorbing area of the muffler.
Figure 7:
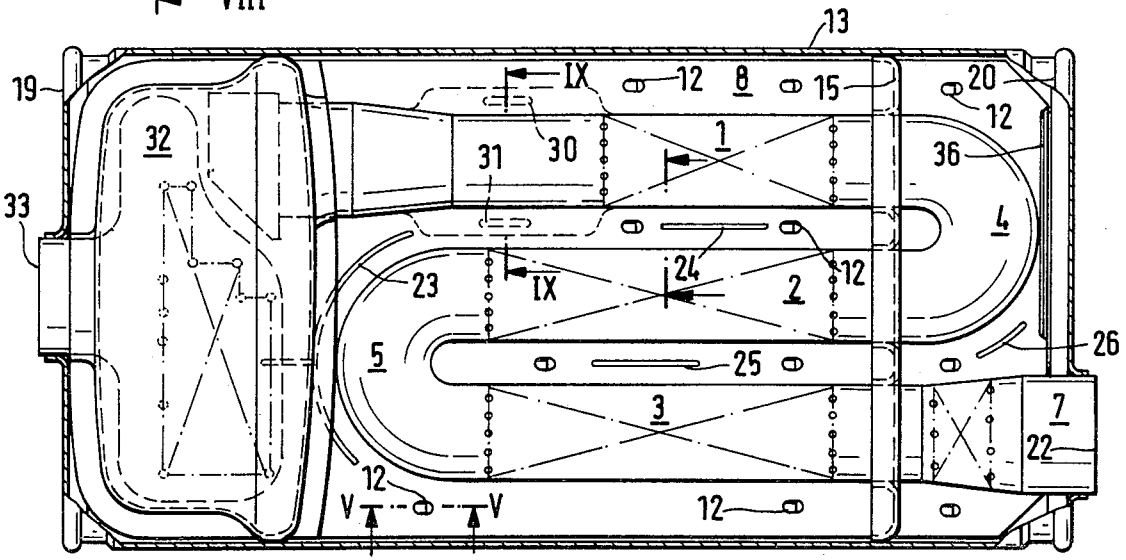
FIG. 7 is a top view, mostly in section, of the muffler illustrated in FIG. 6.

The muffler described above and illustrated in FIGS. 1–5 can be completed, as shown in FIGS. 6–8, with a reflection chamber 32 located at the inlet 33 of the muffler. In the inlet 33 of the muffler extending into the reflection chamber 32, is a perforated inlet member 34. The remainder of the muffler in FIGS. 6–8 is the same as the muffler described above.

While specific embodiments of the invention have been shown and described in detail to illustrate the application of the inventive principles, it will be understood that the invention may be embodied otherwise without departing from such principles.

I claim:

1. A muffler comprising means forming a sound absorbing housing divided into chambers, means forming a sinuous shaped gas duct located within and extending through the chambers within said housing, said means forming said gas duct comprising a pair of sheet metal plates connected together and each of said plates having a semi-circular depression so that the semi-circular depressions in combination form a gas duct for the flow of exhaust gases through said housing, wherein the improvement comprises that each of said plates has punched out lugs forming openings in said plate so that said lugs in one said plate fit into the openings in the other said plate and are bent into engagement with the other said plate for securing said plates together, and means for preventing partial short circuiting between adjacent parts of the sinuously shaped gas duct comprising impressed corrugations in said plates disposed in interengaging form-locking relation.

2. A muffler, as set forth in claim 1, wherein each of said plates has a front edge defining the inlet end of the gas duct and a rear edge defining the outlet end of the gas duct, and the front and rear edges of said sheet metal plates are bent out of the planes of said plates so that they form an angle of less than 90° with the plate.

3. A muffler, as set forth in claim 1 or 2, wherein a gas deflector is positioned in said gas duct intermediate the ends thereof, said deflector having lugs thereon, at least one of said plates having openings therethrough arranged to receive said lugs of said deflector with said lugs bent into engagement with said at least one plate for securing said gas deflector within said gas duct.

4. A muffler, as set forth in claim 1, wherein said lugs are arranged in each of said plates in a uniform spaced pattern so that said lugs in one said plate align with the openings in the other said plate.

5. A muffler, as set forth in claim 1, wherein said housing has an inlet end and an outlet end, said gas duct extending from the inlet end to the outlet end of said housing, said gas duct comprising a plurality of side-by-side rectilinear parts interconnected by U-shaped curved parts so that the length of said gas duct within said housing is multiple of the length of said housing.

* * * * *